US006923502B2

(12) United States Patent
Cassaday

(10) Patent No.: US 6,923,502 B2
(45) Date of Patent: Aug. 2, 2005

(54) CHAIR WITH SWITCH CONTROLS FOR CHAIR CONTROL DIRECTORY

(76) Inventor: Terry Cassaday, 5616 McAdam Rd., Mississauga, Ontario (CA), L4Z 1P2

( * ) Notice: Subject to any disclaimer, the term of this patent is extended or adjusted under 35 U.S.C. 154(b) by 1 day.

(21) Appl. No.: 10/627,666

(22) Filed: Jul. 28, 2003

(65) Prior Publication Data

US 2005/0023871 A1 Feb. 3, 2005

(51) Int. Cl.[7] ..... A47C 7/62

(52) U.S. Cl. ..... 297/217.3; 297/217.4; 297/188.14; 297/188.19; 297/463.1; 297/463.2; 40/320

(58) Field of Search ..... 297/217.3, 217.4, 297/188.14, 463.1, 463.2, 188.19; 40/320, 727

(56) References Cited

U.S. PATENT DOCUMENTS 576,054 A * 1/1897 Hagan ..... 40/320
783,542 A * 2/1905 Redpath et al. ..... 40/320
935,856 A * 10/1909 Thomas ..... 40/320 X
993,397 A * 5/1911 O'Connor ..... 40/320
1,066,292 A * 7/1913 Le Purge ..... 40/320
1,489,113 A * 4/1924 Brookbank ..... 40/320
4,868,888 A * 9/1989 Dayton ..... 297/217.4 X
5,177,616 A * 1/1993 Riday ..... 297/217.3 X
5,318,340 A * 6/1994 Henry ..... 297/217.4
5,678,886 A * 10/1997 Infanti ..... 297/217.3
5,700,051 A * 12/1997 Newhouse ..... 40/320 X
5,779,305 A * 7/1998 Hocking ..... 297/217.4
5,807,177 A * 9/1998 Takemoto et al. ..... 297/217.3
5,997,080 A * 12/1999 Newhouse et al. ..... 40/320 X
6,003,940 A * 12/1999 Jackson ..... 297/217.3
6,102,476 A * 8/2000 May et al. ..... 297/217.3
RE36,928 E * 10/2000 Newhouse et al. ..... 40/320
6,227,615 B1 * 5/2001 Newhouse et al. ..... 40/320 X
6,408,552 B1 * 6/2002 Faulkner ..... 40/320
6,428,124 B1 * 8/2002 Bluth et al. ..... 297/217.3 X
6,530,842 B1 * 3/2003 Wells et al. ..... 297/217.3 X
2002/0070590 A1 * 6/2002 Carstens ..... 297/217.3
2002/0190549 A1 * 12/2002 Chien-Chuan ..... 297/217.3
2003/0107248 A1 * 6/2003 Sanford et al. ..... 297/217.3
2003/0209924 A1 * 11/2003 Bauer et al. ..... 297/217.3
2004/0007907 A1 * 1/2004 DiRe ..... 297/217.3
2004/0174054 A1 * 9/2004 Franke ..... 297/217.3
2004/0183346 A1 * 9/2004 Sanford et al. ..... 297/217.3
2004/0189063 A1 * 9/2004 Furukawa et al. ..... 297/217.3
2004/0195876 A1 * 10/2004 Huiban ..... 297/217.3

FOREIGN PATENT DOCUMENTS

EP 251643 A2 * 1/1988 ..... 297/217.3

* cited by examiner

*Primary Examiner*—Rodney B. White
(74) *Attorney, Agent, or Firm*—Eugene J. A. Gierczak

(57) ABSTRACT

An office chair has multiple moving parts and controls for the different moving parts of the chair. The chair includes a control directory which is in a more visibly accessible position than the controls to a person sitting in the chair. The chair further includes control switches which when activated provide a guide to distinguish which particular set of instructions on the directory pertains to each of the controls. The control switches are activated without producing operation of the actual controls.

18 Claims, 6 Drawing Sheets

CHAIR WITH SWITCH CONTROLS FOR CHAIR CONTROL DIRECTORY

FIELD OF THE INVENTION

The present invention relates to a chair having moveable chair parts, controls for the moveable chair parts and a switch operated directory for operation of the chair part controls.

BACKGROUND OF THE INVENTION

The most up to date office type chairs are becoming more and more sophisticated in respect of the different adjustments that can be made to these types of chairs. For example, both the chair back and the chair seat of an office chair may be adjustable to a number of different settings. Typically, each of these settings is adjusted by an individual chair control specific to each setting. All of the chair controls are generally located below the chair seat.

A particularly irritating drawback of the above described chair is that understanding of the use of the controls is often difficult. Much of the difficulty results from the positioning of the chair controls below the chair seat where they are not readily visibly accessible.

In view of the above, the operation of most chair controls is done on a trial and error basis by a person using the chair. That person, until having a full understanding of the chair, which generally comes only after extended chair usage, will try each control to determine its function. This can often be frustrating because the control may move a chair part which has already been set to an appropriate position and will then need resetting which is sometimes, at the very least, an awkward thing to do. In some cases the person may not be able to properly reset the chair which is both frustrating and embarrassing. In even a worse case scenario, the adjustment of the chair part without knowing what will happen, can actually be dangerous. For example, if the seating tension on the chair is reset from a light to a much heavier spring tension, a light weight person sitting on the chair while doing the resetting can be thrown from the chair. Obviously, this is only one of many awkward situations that might be created by the trial and error testing of the chair controls.

SUMMARY OF THE PRESENT INVENTION

The present invention relates to an advancement in chairs having multiple moving parts and controls for those parts in which a user of the chair is able to quickly and easily understand the operation of the chair controls without having to physically maneuver the controls.

More particularly, according to the present invention a chair having multiple moving parts and controls for those moving parts includes a chair control directory which is in a more visibly accessible position than the controls are to a person sitting in the chair. The chair further includes control switches which, when activated, operate to distinguish which particular set of instructions on the directory pertains to each of the controls without having to physically use the controls.

According to an aspect of the invention, each of the controls has a switch and the chair includes feedback means operated by each of the switches. The feedback means upon activation of any one of the switches indicates which control has been selected for use and the directory provides a visual guide showing which chair part will be moved by the control that has been selected. This occurs without having to move the control itself.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION IN WHICH

Figure 1:
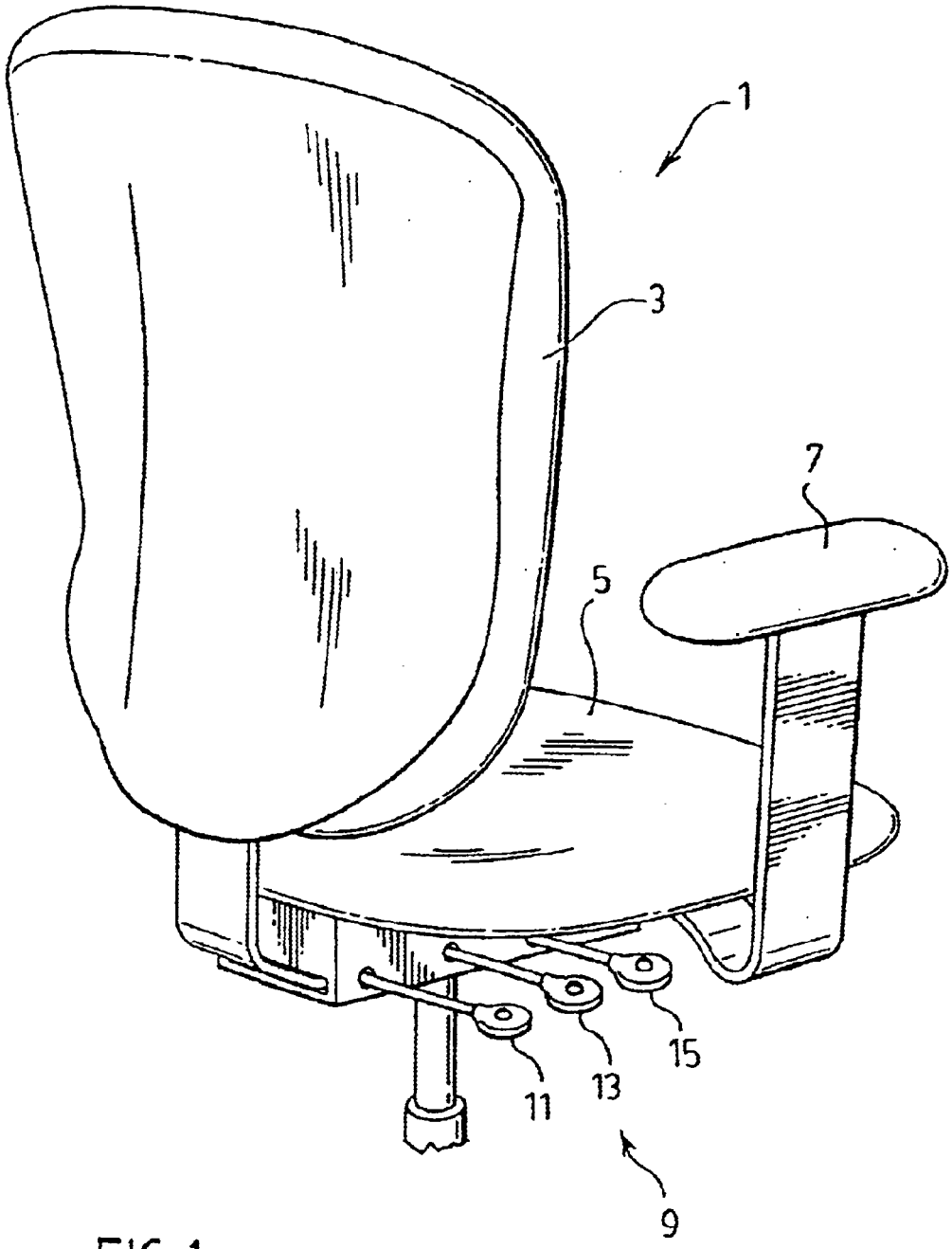
FIG. 1 is a perspective view of an office type chair including chair controls according to a preferred embodiment of the present invention.

FIG. 1 shows a chair (excluding the chair base) generally indicated at 1. This chair has a chair back 3, a chair seat 5 and an armrest 7. Provided below the chair seat 5 is a group 9 of controls including individual controls 11, 13 and 15. These controls are used to provide various different settings for the chair back 3 and the chair back 5 each of which is adjustable in position on the chair. Obviously more controls can be provided for additional chair adjustments.

As will be appreciated from FIG. 1 or as will be understood by anyone who has used an office chair with controls below the chair seat, these controls are not easily seen by a person sitting in the chair. They are however easily reachable by a person sitting in the chair.

Figure 2:
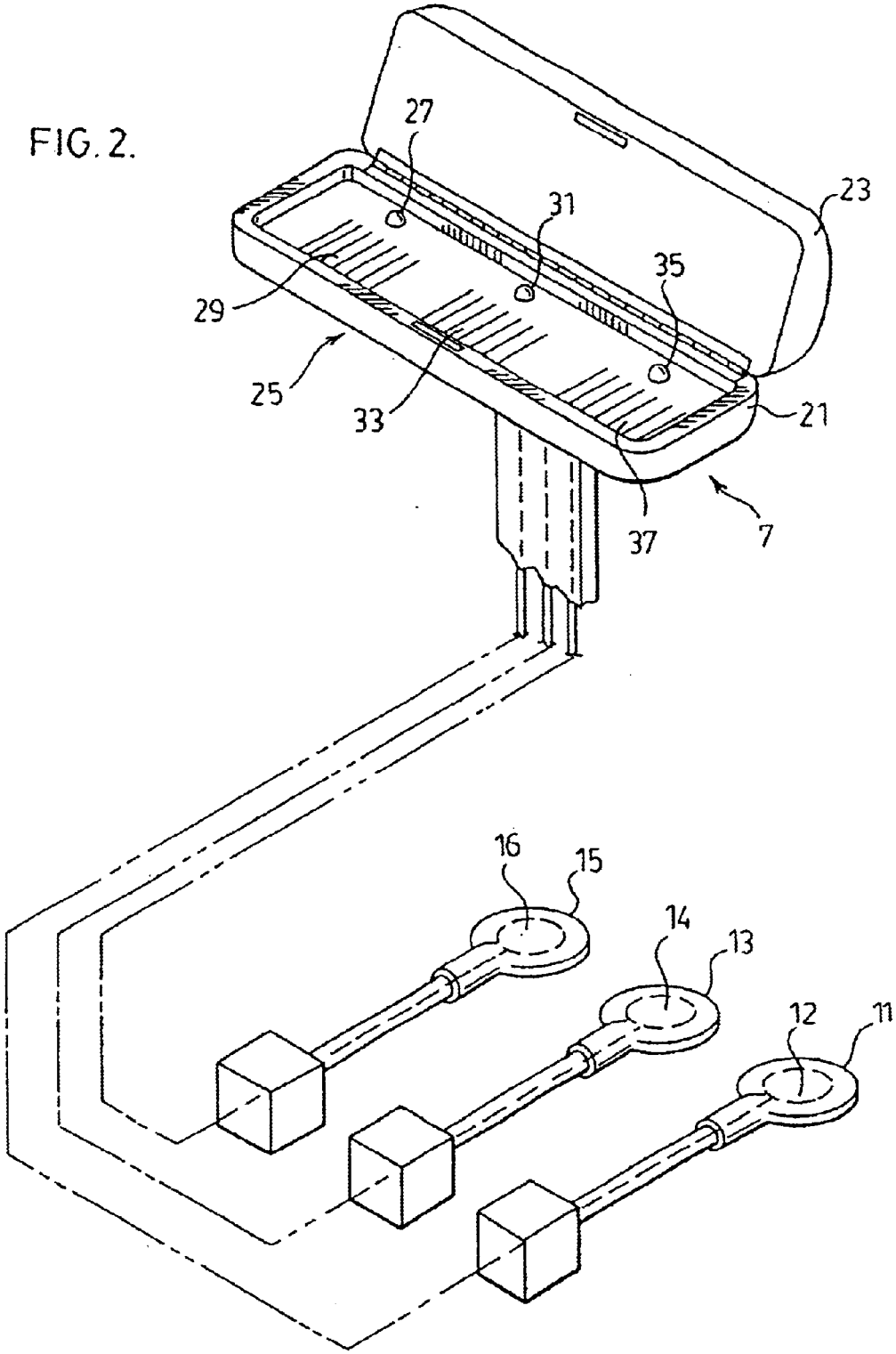
FIG. 2 is a further perspective view showing the connection of the chair controls to the chair control directory according to a preferred embodiment of the present invention.

Referring now to FIG. 2 it will be seen that the controls 11, 13 and 15 include switches 12, 14 and 16 respectively. The armrest 7 includes a main body part 21 fixed atop the armrest support and a top part 23 which can be flipped open to expose a directory generally indicated at 25. This directory includes operating instructions for the chair controls 11, 13 and 15. The operating instructions indicate to a user of the chair which chair part will be moved by which control and how the various different chair parts can be moved by the various different controls.

More specifically, directory 25 includes individual operating instructions 29, 33 and 37. Provided beside operating instructions 29 is an LED 27 with LEDs 31 and 35 being provided beside operating instructions 33 and 37 respectively.

Switch 12 provided in the handle of control 11 is electrically connected to LED 27. The switches 14 and 16 provided in the handles of controls 13 and 15 are electrically connected to LEDs 31 and 35.

In order to operate the chair system shown in FIGS. 1 and 2 a person sitting in the chair will simply reach down and press the switch on any one of the controls which has been selected for use. Note that the pressing of the switch does not cause activation of the control but rather will simply light the appropriate LED. For example, if a person decides that he or she wants to know information with respect to the operation of control 11 the pressing of switch 12 will activate LED 27 alerting the person to review instructions 29 relative to control 11. The person will then understand the functions of the control and the associated chair part without actually moving the control.

The same situation applies to controls 13 and 15 where a person sitting in the chair will press on the switches 14 and 16 to operate LEDs 31 and 35 respectively. When LED 31 is activated the person will then read instructions 33 specific to control 13 whereas when LED 35 is activated the person will read the instructions specific to control 15. In neither case will the person have to actually operate the control in order to understand how the controls work.

When the chair is being used without having to change any of the moving part settings on the chair the flip top 23 of the armrest is simply dropped to a covering position over the directory within the main armrest part 21. This allows the armrest to operate in its normal function.

Figure 3:
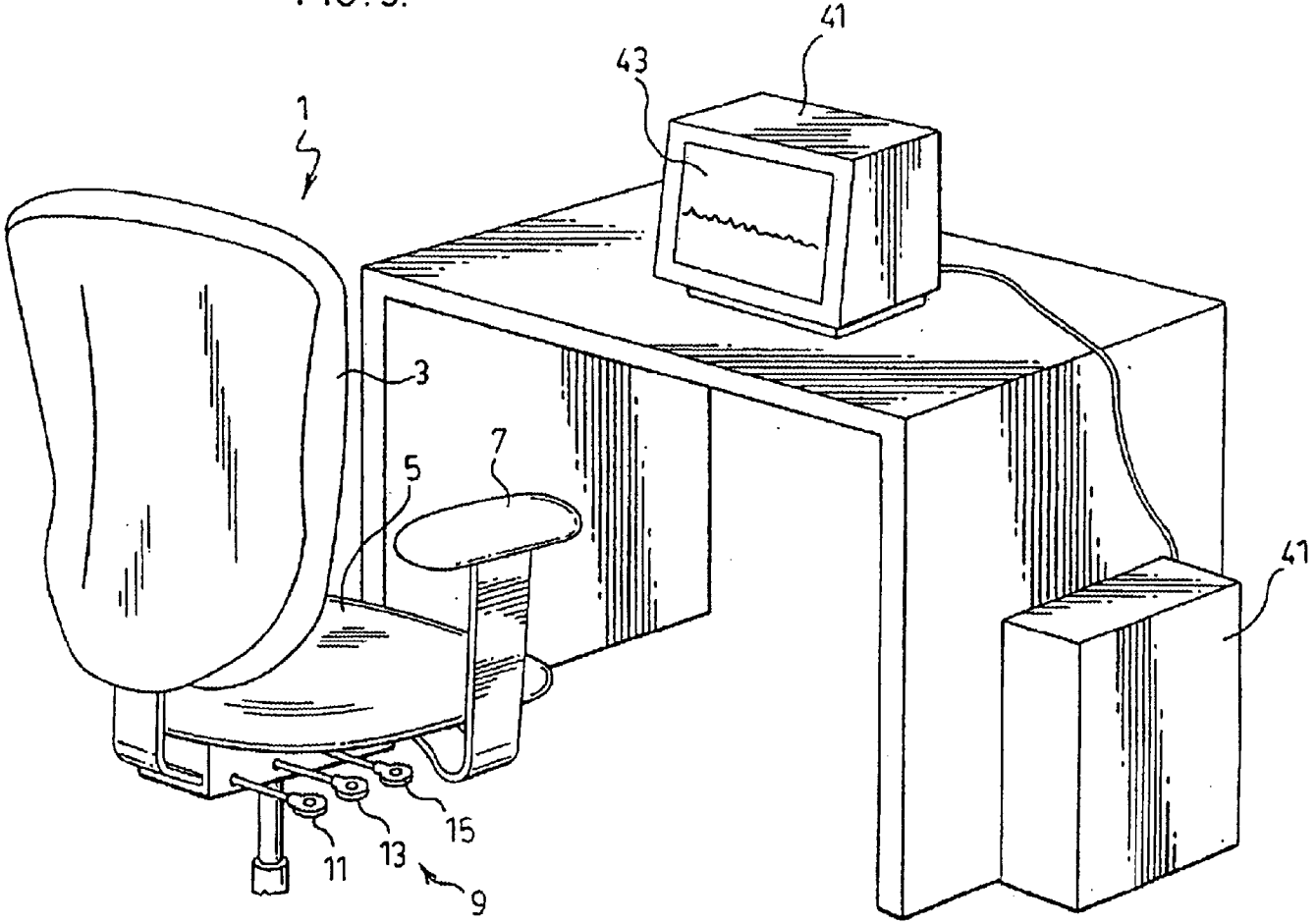
FIG. 3 is a perspective view of a chair having chair controls with switches which produce feedback at a remote instruction directory according to a further preferred embodiment of the present invention.

Although FIG. 2 shows the switches as being wired to the directory, wireless connections for remote control of the directory from the switches can also be provided as seen in FIG. 3. In addition, the directory itself need not be provided in the armrest of the chair so long as it is located in a location that is more visibly accessible than the actual controls to a person sitting in the chair. An example of this type of setup is also shown in FIG. 3 of the drawings.

More specifically FIG. 3 once again shows chair 1 with its group of controls 11, 13 and 15. In addition to or in lieu of the directory being provided in the armrest 7 of the chair, the chair is in electrical communication with a data storage system including a storage unit 40 and a display unit 41 having a screen 43. The switches on the chair are linked to storage unit 40. As shown in FIG. 3 it is preferably a wireless link or connection between the switches and the storage unit.

By pressing any one of the switches an airborne signal is sent from the activated switch to the storage unit. The storage unit then produces information with respect to the particular control that has been selected as per the switch activation. This information which relates to how the control works for controlling one of the chair parts is then displayed on screen 43 of display unit 41.

Figure 4:
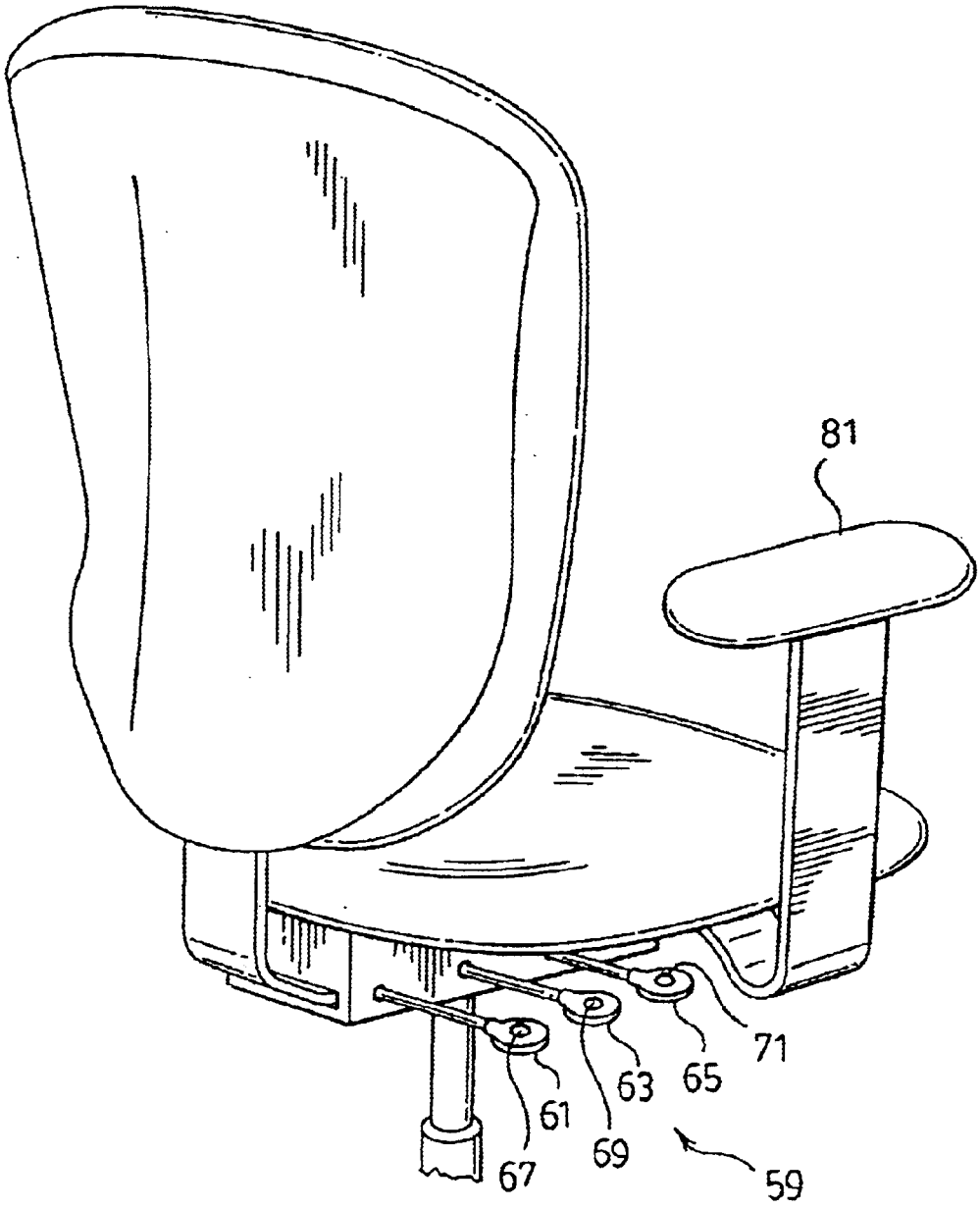
FIG. 4 is a perspective view of a chair with a switch control directory according to yet a further preferred embodiment of the invention.
Figure 5:
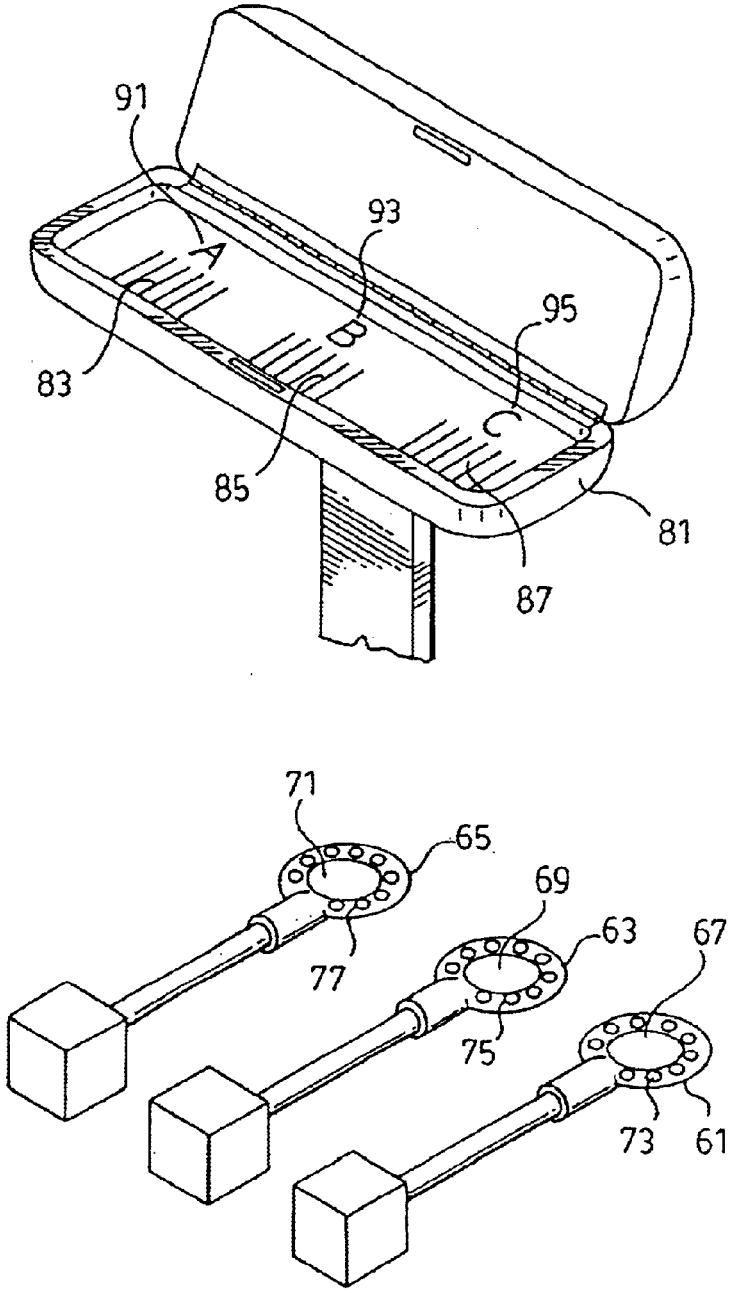
FIG. 5 shows in perspective the controls and directory from the chair of FIG. 4.

FIGS. 4 and 5 of the drawings show another unique embodiment of the invention. In this embodiment the feedback from operation of the control switches is an audible feedback. In particular, office chair 59 includes chair movement controls 61, 63 and 65. These controls include pressure switches 67, 69 and 41. The switches also include speakers 73, 75 and 77 connected to voice chips contained within the paddle controls. The voice chips are activated by pressing on the control switches. Each voice chip will contain a specific instruction pertinent to the particular control in which the voice chip is contained.

Chair 59 includes an armrest 81. Provided interiorly of armrest 81 are three sets of instructions 83, 85 and 87. Letters A, B and C designated by arrows 91, 93 and 95 are located adjacent the separate sets of instructions.

A person sitting in chair 59 will press switch 67 on switch 61. He or she will then hear the instruction "A" and look to the directory in the armrest for the set of instructions 83 designated by letter A. This set of instructions will then give the person information as to what chair part will be moved, and as to how it will be moved by operating control 61.

To understand how controls 63 and 65 operate the person will push switches 69 and 71 respectively. That person will then hear instructions "B" and "C" and look to the directory in the armrest to review the written instructions 85 and 87.

Figure 6:
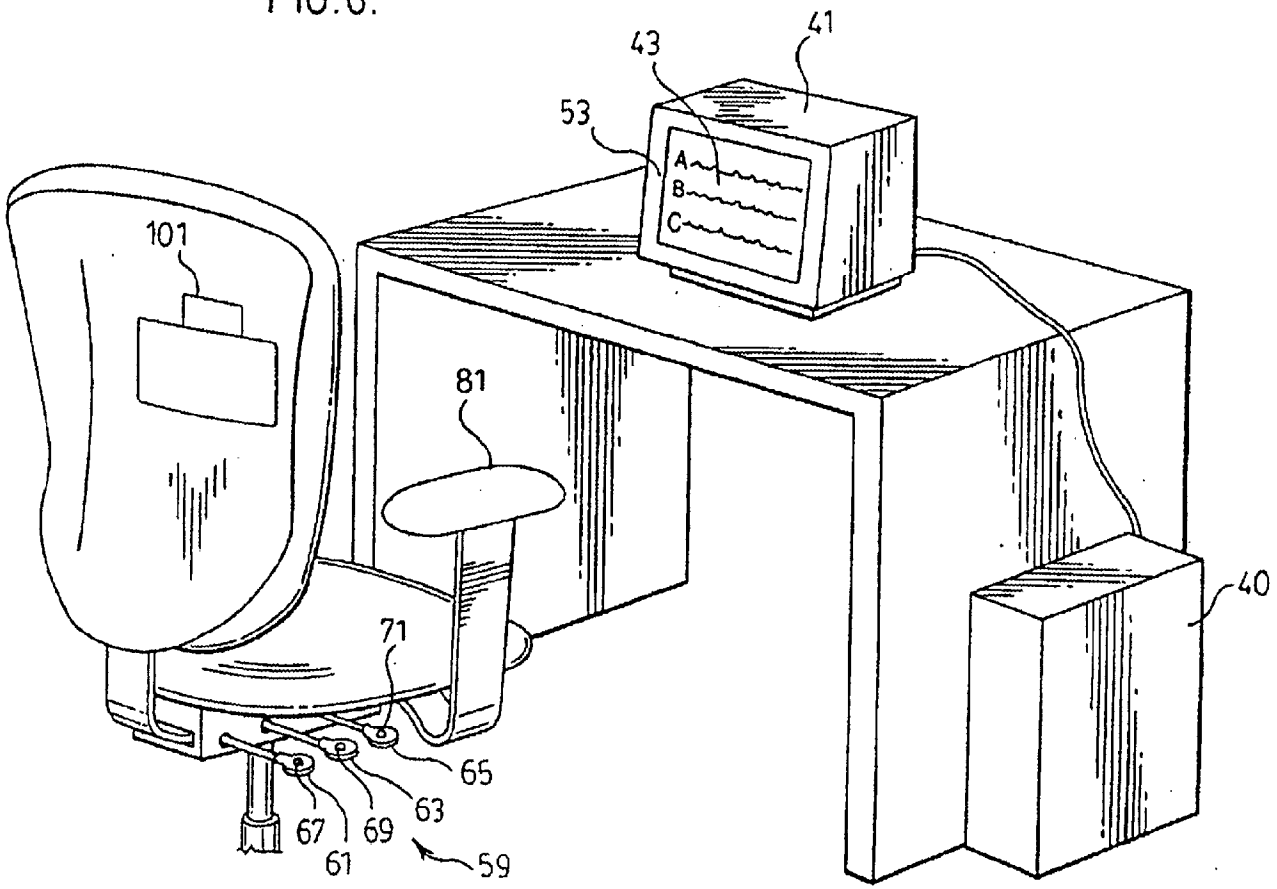
FIG. 6 shows the chair of FIG. 4 when used with a further directory according to still another preferred embodiment of the invention.

FIG. 6 of the drawings shows a further set up for use with a chair having moveable parts with controls having switches to guide the user as to how to use the controls. This set up once again includes chair 59 having controls 61, 63 and 65. These controls with their switches operate in the same manner as described above to produce an audible instruction "A", "B", or "C". However, rather than looking to the chair armrest for the visual or reading instruction for use of the controls, the instructions appear at 53 on the screen 43 of display monitor 41. All of the sets of instructions will be seen at one time on the display screen and the person in the chair will know which set of instructions is to be read by the reference letters "A", "B" and "C" appearing beside the instructions.

As a further feature of the invention a separate instruction booklet 101 is provided with the chair to be used as a remote visual guide in lieu of the display monitor. This booklet also contains the separate sets of instructions for the chair controls designated by the reference letters "A", "B" and "C".

Although various preferred embodiments of the present invention have been described in detail, it will be appreciated by those skilled in the art that variations may be made without departing from the spirit of the invention or the scope of the appended claims.

The Embodiments of the Invention in which an exclusive property or privilege is claimed are defined as follows:

1. A chair having a moveable back and moveable seat; controls disposed below said seat for selectively moving said back and seat, a chair control directory which is in a more visibly accessible position than said controls to a person sitting in said chair, each of said controls having a switch, feedback means activated by each said switch for distinguishing which control has been selected without activating said control and said directory providing a visual guide showing which of said back and seat will be moved by the control that has been selected.

2. A chair as claimed in claim 1 wherein said feedback means provides visual feedback indicating the control has been selected by activation of the switches of the controls.

3. A chair as claimed in claim 1 wherein said feedback means provides audible feedback indicating the control that has been selected by activation of the switches at the controls.

4. A chair as claimed in claim 3 wherein each of said controls includes a voice chip with a speaker which outputs the feedback from the voice chip.

5. A chair having at least first and second moveable chair parts, a first control for movement of said first chair part, a second control for movement of said second chair part, a chair control directory which is in a more visibly accessible position than said first and second controls to a person sitting in said chair, said first control having a first switch, said second control having a second switch, said chair having feedback means which is operated by said first switch to indicate selection of said first control capable of moving said first chair part when said first control is selected for use and which is operated by said second switch to indicate selection of said second control capable of moving said second chair part when said second control is selected for use, said directory providing a visual guide showing that the first chair part will be moved when the first control has been selected for use and showing that the second chair part will be moved when the second control has been selected for use, said switches independently operable from said controls.

6. A chair as claimed in claim 5 wherein said directory includes a first instruction relating to said first control and to said first chair part and a second instruction relating to said second control and to said second chair part, said feedback means comprising a first visual indicator providing a guide to review said first instruction upon activation of said first switch on said first control and a second visual indicator providing a guide to review said second instruction upon activation of said second switch on said second control.

7. A chair as claimed in claim 6 wherein said first visual indicator comprises a first light provided on said directory adjacent said first instruction and said second visual indicator comprises a second light on said directory adjacent said second instruction.

8. A chair as claimed in claim 6 wherein said chair includes a chair seat and an arm rest above said chair seat, said first and second controls being located below said chair seat and said directory with said first and second visual indicators being provided at said arm rest of said chair.

9. A chair as claimed in claim 6 wherein said chair is in electrical communication with data storage means having a display screen located remotely of said chair, the activation of any one of the switches producing the visual guide at said display screens.

10. A chair as claimed in claim 9 wherein the electrical communication is a wireless communication from said switches of said controls to said data storage means.

11. A chair having:

(a) a moveable back and seat;

(b) a back control lever for selectively moving and locking said back in position;

(c) a seat control level for selectively moving and locking said seat in position;

(d) said levers disposed below said seat;

(e) each said control lever carrying a switch independently operable from said control lever;

(f) a chair control directory viewable to a person sitting in said chair and including instructions pertaining to the operation of each said control lever;

(g) a sensory indicator associated with each said instructions pertaining to the operation of each said control lever each said sensory indicator activated by one of said switches so as to show the operation of said control lever when said control lever is activated.

12. A chair as claimed in claim 11 wherein said sensory indicator comprises a LED disposed beside instructions pertaining to the operation of said back control lever, and an LED disposed beside instructions pertaining to the operation of said seat control lever.

13. A chair as claimed in claim 12 wherein said chair includes an arm rest and said chair control directory is disposed on said arm rest.

14. A chair as claimed in claim 13 wherein said switches are electrically connected to said chair control directory.

15. A chair as claimed in claim 13 wherein said switches comprise wireless connections to said chair control directory.

16. A chair as claimed in claim 12 wherein said chair control directory comprises a data storage system and a display unit having a screen.

17. A chair as claimed in claim 16 wherein said switches have a wireless link to said data storage system.

18. A chair as claimed in claim 12 wherein said sensory indicators comprise speakers carried by each said switch, so as to audibly hear said instructions upon activation of said switches.

* * * * *